US008251205B2

(12) United States Patent
Azera

(10) Patent No.: US 8,251,205 B2
(45) Date of Patent: Aug. 28, 2012

(54) CONTACT LENS CASE

(76) Inventor: Paule Azera, San Diego, CA (US)

( * ) Notice: Subject to any disclaimer, the term of this patent is extended or adjusted under 35 U.S.C. 154(b) by 31 days.

(21) Appl. No.: 12/620,548

(22) Filed: Nov. 17, 2009

(65) Prior Publication Data

US 2010/0122917 A1 May 20, 2010

Related U.S. Application Data

(60) Provisional application No. 61/115,443, filed on Nov. 17, 2008.

(51) Int. Cl.
*A45C 11/04* (2006.01)

(52) U.S. Cl. ..... 206/5.1

(58) Field of Classification Search ..... 206/5, 5.1, 206/6

See application file for complete search history.

(56) References Cited

U.S. PATENT DOCUMENTS

| | | | | | |
|---|---|---|---|---|---|
| 1,342,524 | A | * | 6/1920 | Ament | 222/142.4 |
| 1,655,452 | A | | 1/1928 | Ament | |
| 2,650,597 | A | | 9/1953 | Girard | |
| 3,052,246 | A | | 9/1962 | Beard | |
| D196,681 | S | | 10/1963 | Middleton | |
| 3,186,540 | A | * | 6/1965 | Breger | 206/5 |
| 3,211,281 | A | | 10/1965 | Speshyock et al. | |
| 3,460,552 | A | * | 8/1969 | Sturgeon | 134/135 |
| 3,519,005 | A | * | 7/1970 | Krezanoski et al. | 134/143 |
| 3,645,284 | A | * | 2/1972 | Krezanoski et al. | 134/166 R |
| 3,661,248 | A | * | 5/1972 | Isen et al. | 206/5 |
| 3,822,780 | A | | 7/1974 | Ulmer et al. | |
| 3,934,723 | A | * | 1/1976 | Walker | 206/422 |
| 4,337,858 | A | * | 7/1982 | Thomas et al. | 206/5.1 |
| 4,415,076 | A | | 11/1983 | Figari | |
| 5,375,699 | A | * | 12/1994 | Amend | 206/5.1 |
| 5,407,062 | A | * | 4/1995 | Shannon et al. | 206/5.1 |
| D358,477 | S | | 5/1995 | De Meo | |
| 5,433,314 | A | | 7/1995 | Lin | |
| 5,573,108 | A | * | 11/1996 | Hamilton et al. | 206/5.1 |
| D388,602 | S | | 1/1998 | Petruzzi | |
| 6,044,966 | A | * | 4/2000 | Haase | 206/5.1 |
| 6,170,664 | B1 | * | 1/2001 | Dar | 206/5.1 |
| 6,286,666 | B1 | * | 9/2001 | Umdasch | 206/5.1 |
| 6,343,612 | B1 | * | 2/2002 | Dahl | 134/117 |
| 6,435,339 | B1 | * | 8/2002 | Kroupa | 206/5.1 |
| 6,471,052 | B2 | * | 10/2002 | Faxe et al. | 206/5.1 |
| 7,832,551 | B2 | * | 11/2010 | Newman et al. | 206/5.1 |
| 2005/0045495 | A1 | * | 3/2005 | Dalsing et al. | 206/5.1 |
| 2005/0109638 | A1 | | 5/2005 | Eastman | |
| 2007/0000792 | A1 | * | 1/2007 | Newman et al. | 206/5.1 |
| 2007/0170075 | A1 | | 7/2007 | Winters et al. | |
| 2007/0261970 | A1 | * | 11/2007 | Stull | 206/5.1 |

FOREIGN PATENT DOCUMENTS

| | | |
|---|---|---|
| JP | 2005046401 | 2/2005 |
| JP | 2006122184 | 5/2006 |

* cited by examiner

*Primary Examiner* — Mickey Yu
*Assistant Examiner* — Rafael Ortiz
(74) *Attorney, Agent, or Firm* — Lewis Kohn & Fitzwilliam LLP; Timothy W. Fitzwilliam

(57) ABSTRACT

A new design for a contact lens case is disclosed herein. In a preferred embodiment, the design provides storage for extra contact lenses in the event that one contact is damaged or lost. Further in a preferred embodiment, a separate compartment is provided for housing a mirror. Optionally, the reservoirs holding contacts form a yin yang shape. Other embodiments provide a more compact solution that further includes a novel thumb latch design. Additionally in another embodiment, all compartments are located upon one another in the same footprint.

11 Claims, 5 Drawing Sheets

Figure 1E
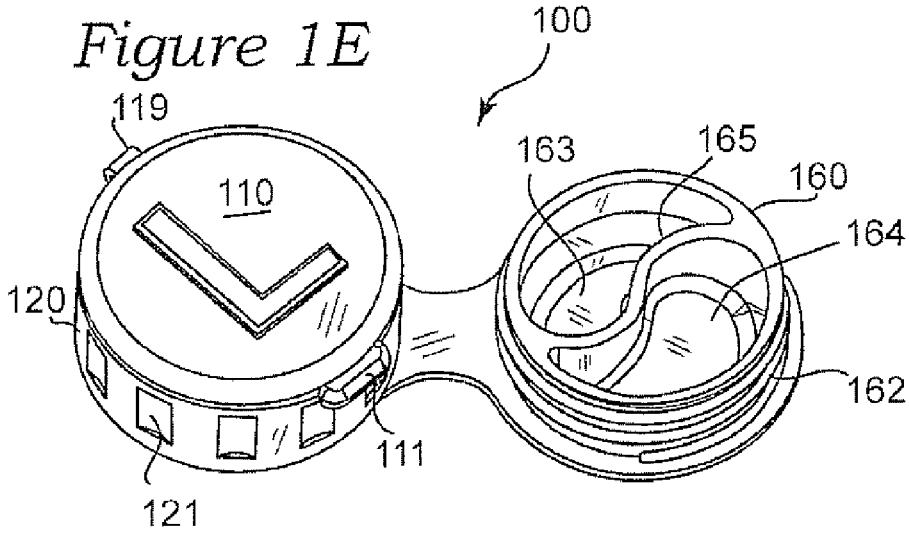
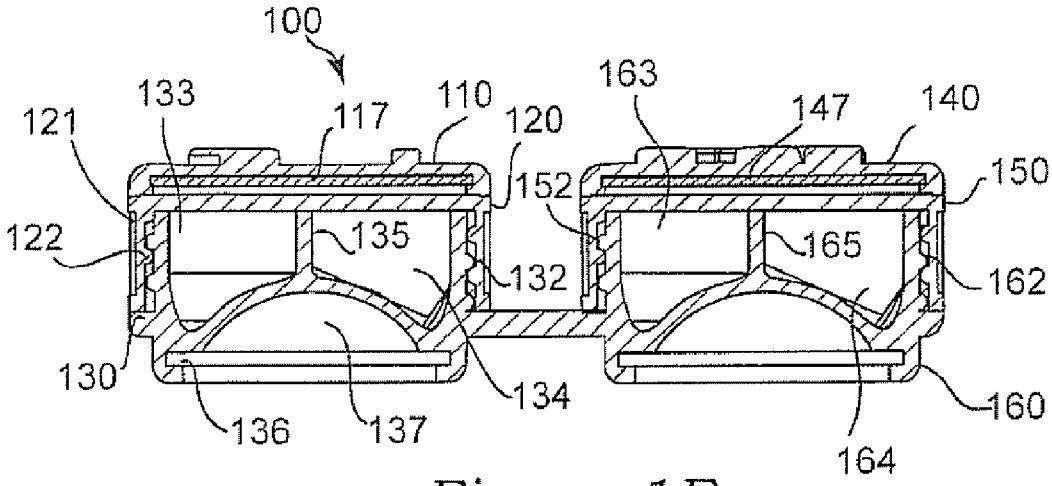
Figure 1F

CONTACT LENS CASE

PRIORITY CLAIM

This patent application contains subject matter claiming benefit of the priority date of U.S. Provisional Patent Application Ser. No. 61/115,443 filed on Nov. 17, 2008 and entitled CONTACT LENS CASE, accordingly, the entire contents of this provisional patent application is hereby expressly incorporated by reference.

BACKGROUND OF THE INVENTION

1. Field of the Invention

The present invention pertains generally to devices and method for storing and assisting the placement of contact lens. More specifically, the present invention relates to contact lens cases having mirrored surfaces incorporated thereto, further having extra compartments for housing the mirrors and extra contact lenses.

2. Description of the Prior Art

Contact lens cases have been known for some time and even designs having mirrors somehow incorporated thereto. An early example was granted patent rights in 1965, entitled CONTACT LENS STORAGE MEANS, U.S. Pat. No. 3,211,281, to R. F. Speshyock et al. However, this example appears to be bulky in design and needs more space to accompany rinsing and storing fluid.

A more recent example was disclosed by Michael Eastman, entitled COMPACT MIRRORED CONTACT LENS CASE, U.S. Pat. App. Pub. No. 2005/0109638. This design is disadvantageous because the mirror always remains exposed on an outside of the case and the case is not a unitary piece, therefore, a user is required to remove the mirror and replace the mirror to use the device. No solutions heretofore, provide additional compartments for storing spare contact lenses in the event that a contact becomes lost or damaged.

Further while these examples may be suitable for their stated intensions and objectives, additional novel products are disclosed herein that have attractive features to consumers not yet seen heretofore. In light of the above, it is an object of the present invention to provide a novel design for a contact lens case that includes a reflective surface being protected from the outside environment. It is an additional object of the present invention to provide novel thumb latches to a compact lens case design. It is still further an object of the present invention to provide a stacked compartment design that contact lens consumers may find preferable to existing designs. It is yet still further an object of the present invention to provide a contact lens case that provides extra compartments for spare contacts lenses.

BRIEF SUMMARY OF THE INVENTION

The present invention specifically addresses and alleviates the above mentioned deficiencies associated with the prior art. More particularly, the present invention comprises a case for storing contact lenses comprising: a first circular base portion having a hollow interior for storing contact lenses; a first threaded cap having threads to engage complementary threads of the first circular base portion; and a first hinged cap hingedly connected to the first threaded cap, wherein the first hinged cap comprises a reflective surface at an underside thereof.

Additionally, the present invention is characterized as further comprising: a plurality of indentations evenly spaced around the first threaded cap to aid grasping thereof by a user;

a groove at an underside of the first circular base portion, the groove configured to receive an edge of a spare contact lens package; and a cavity formed partially by the groove for receiving the spare contact lens package.

Further, the invention is characterized wherein the first circular base further comprises two identical bowl shaped reservoirs separated by a partitioning wall, the two reservoirs configured to store a contact lens. Also, the first circular base further comprises two reservoirs separated by an S shaped partitioning wall, the two reservoirs together forming a yin yang shape.

The present invention is further circumscribed as comprising: a first hinge comprised of pliable material to connect the first hinged cap to the first threaded cap; and a first thumb latch to assist in opening the first hinged cap, wherein the first hinge and the first thumb latch are offset at an angle with respect to a vertical axis, the vertical axis representing a twelve o'clock position with respect to first hinged cap.

Still further, the invention is characterized as further comprising: a second circular base portion having a hollow interior for storing contact lenses; a second threaded cap having threads to engage complementary threads of the second circular base portion; and a second hinged cap hingedly connected to the second threaded cap, wherein the second hinged cap comprises a reflective surface at an underside thereof, and wherein each of the first and second base portions comprise two reservoirs for storing a total of four contact lenses.

In another preferred embodiment, the invention is set forth as a case for storing contact lenses comprising: a first base portion having a first reservoir to receive a contact lens; a cap for enclosing the first reservoir, the cap including a top and underneath sides; a first hinge for hingedly connecting the cap to the first base portion; and a basin on the underneath side of the cap, the basin configured to receive a reflective surface to assist placement and removal of contacts.

Further in this preferred embodiment, the invention is further characterized wherein the first base portion further comprises a carve-out at an edge of the first base portion, the carve out having a shape of a frustum of a pie wedge, wherein the cap has a latch protruding therefrom, wherein the carve out is further configured to receive the corresponding latch.

Yet further in this preferred embodiment, the invention is further characterized as comprising a second base portion configured under the first base portion and opposite the cap, the second base portion further having a second reservoir to receive a contact lens. Also in this embodiment, the first base portion and the second base portion are stacked in the same footprint.

These, as well as other advantages of the present invention will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawing, taken in conjunction with the accompanying description, in which similar reference characters refer to similar parts, and in which:

FIG. 1E is an additional perspective illustration of the embodiment first presented in FIG. 1A, however showing a preferred embodiment of contact lens compartments;

FIG. 1F illustrates a cross sectional view of the invention embodiment taken along sectional lines 1F-1F in FIG. 1A;

DESCRIPTION OF PREFERRED EMBODIMENTS

Figure 1A:
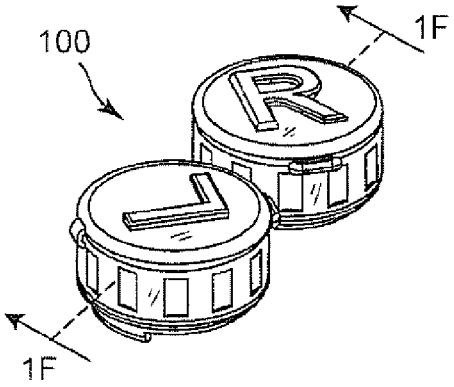
FIG. 1A is a perspective view of a first preferred embodiment of the present invention.

Initially referring to FIGS. 1A and 1F; a perspective illustration of a first preferred embodiment 100 is shown in addition to a cross-sectional view of the invention taken along sectional line 1F-1F. As shown, the contact lens case 100 has a first circular base portion 130 having a hollow interior for storing multiple contact lenses. This embodiment has two caps 110, 120; namely a first threaded cap 120 having threads 122 to engage complementary threads 132 of the first circular base portion 130 and a first hinged cap 110 hingedly connected to the first threaded cap 120. This embodiment also includes a reflective surface 117 at an underside of the first hinged cap 110 that remains protected from dirt and debris with in a stowed position.

Also referring to FIG. 1F, a groove 136 is provided at an underside of the first circular base portion 130. Groove 136 is further configured to receive an edge of a spare contact lens package in the event that a user loses or damages a contact lens. Cavity 137 is partially formed by groove 136 and extends into an underside of the first base portion 130. This space 137 is provided to accommodate the spare contact lens.

For storing contacts lenses in use a first reservoir 133 is configured next to a second reservoir 134 separated by a partitioning wall 135 as shown. The contact lens case 100 also has a second circular base 160 portion having a hollow interior for storing more contact lenses. As shown a second threaded cap 150 has threads 152 to engage complementary threads 162 of the second circular base portion 160. Further, a second hinged cap 140 is provided hingedly connected to the second threaded cap 150, wherein the second hinged cap comprises a reflective surface 147 at an underside thereof. Also as shown, each of the first 130 and second 160 base portions comprise two reservoirs 133, 134, 163, 164 for storing a total of four contact lenses.

Figure 1B:
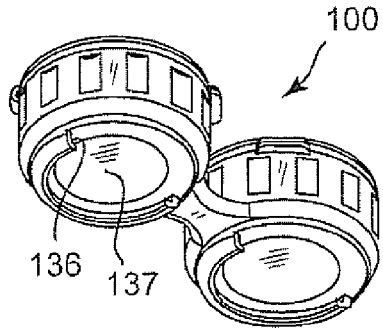
FIG. 1B is perspective view of the embodiment illustrated in FIG. 1A taken from an underneath vantage point.
Figure 1C:
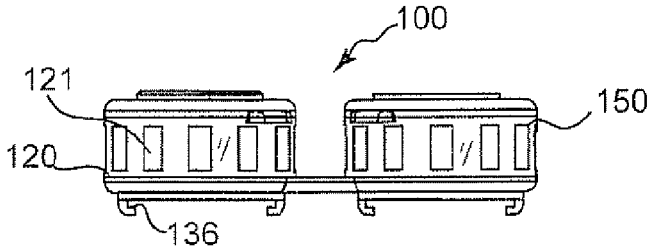
FIG. 1C illustrates a front plan view to the invention embodiment.

With regard to FIG. 1B a perspective illustration of the embodiment 100 is illustrated from an underside thereof. Here, groove 136 and cavity 137 are additionally shown to reveal their shape and configuration. FIG. 1C shows a front plan view of the invention embodiment 100, illustrating a plurality of indentations 121 evenly spaced around the threaded caps 120, 150 to aid grasping thereof by a user.

Figure 1D:
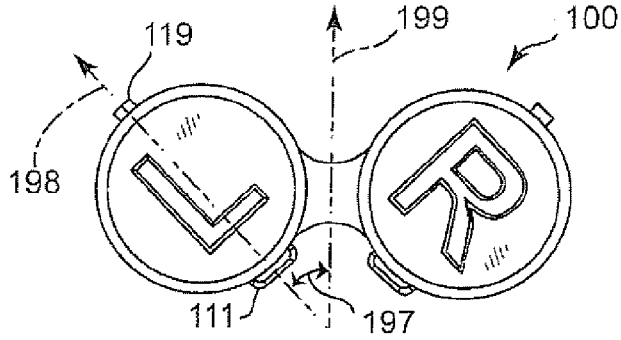
FIG. 1D illustrates a top plan view showing how a hinge and latch are offset according to an embodiment of the present invention.

Referring to FIG. 1D, a first thumb latch 111 is provided to assist in opening the first hinged cap 110, wherein the first hinge 119 and the first thumb latch 111 are offset at an angle 197 with respect to a vertical axis 199, the vertical axis 199 representing a twelve o'clock position with respect to first hinged cap 110. Angle 197 is shown between the vertical axis 199 and the offset axis 198.

Referring to FIG. 1E, the second 160 (and first 130) circular base further comprise two reservoirs 163, 164 separated by an S shaped partitioning wall 165. As shown, the two reservoirs 163, 164 together forming a yin yang shape. In this embodiment 100, the first and second base portions 130, 160 would have identically shaped compartments. Additionally as shown, first hinge 119 is comprised of pliable material to connect the first hinged cap 110 to the first threaded cap 120. It is further completed that the entire device 100 can be comprised of biodegradable material.

Figure 2:
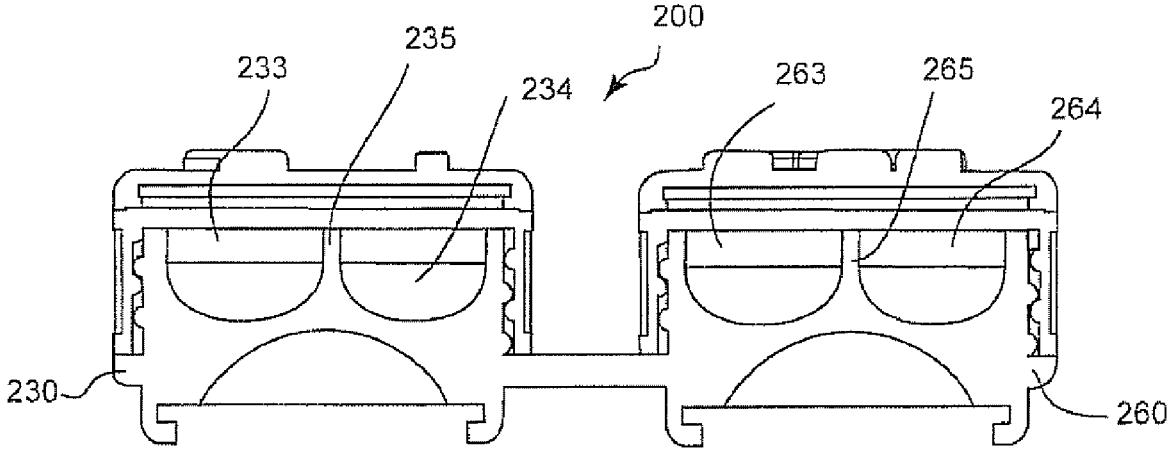
FIG. 2 illustrates another invention embodiment having multiple inside compartments for extra contacts.

Referring to FIG. 2, a sectional view of an additional embodiment of a contact lens case 200 is shown. Herein, the first circular base 230 further comprises two identical bowl shaped reservoirs 233, 234 separated by a partitioning wall 235 configured to store a contact lenses. As expected, second base portion 260 has two identical bowl shaped reservoirs 263, 264 separated by their partitioning wall 265.

Figure 3:
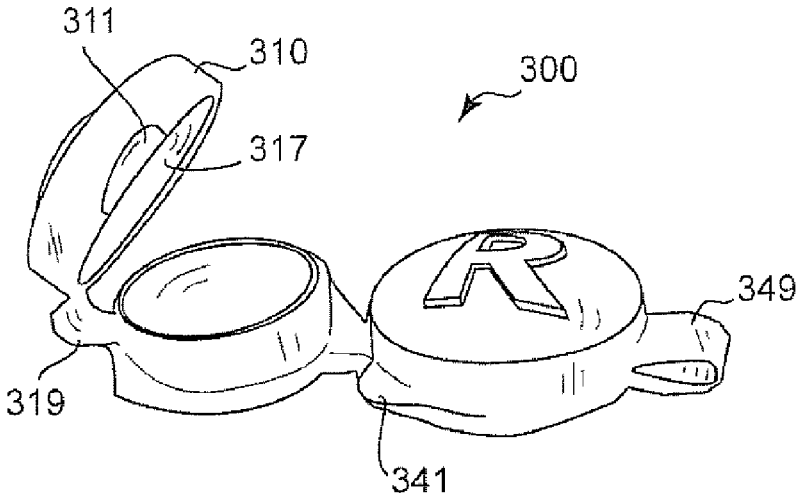
FIG. 3 is a perspective view of another mirrored contact storage case embodiment of the present invention.

Referring to FIG. 3, another embodiment 300 is illustrated. Herein, thumb tabs 311, 341 are offset as in FIG. 1D, however pliable hinges 319 and 349 are aligned with what would be the horizontal axis by comparison to FIG. 1D. Also, cap 310 has a reflective surface 317 on an underside thereof.

Figure 4A:
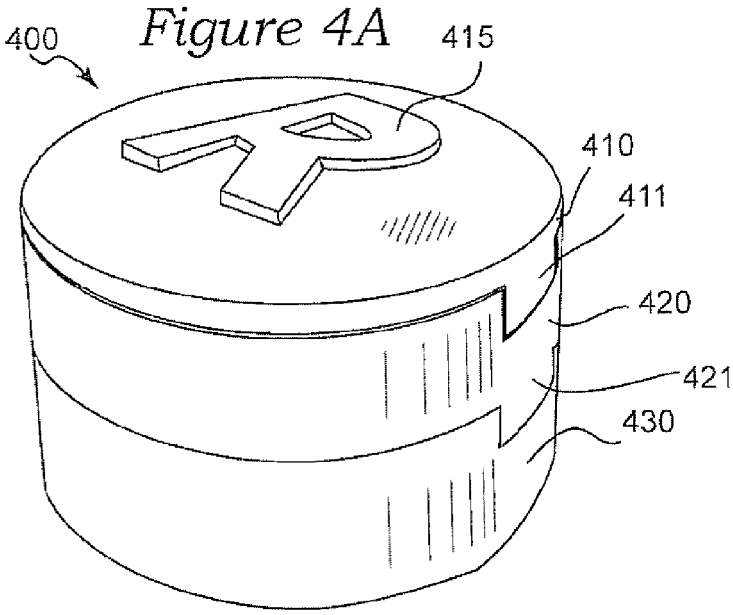
FIG. 4A is a perspective drawing showing an outside view of a first embodiment of present invention in a stowed position.

Now with reference to FIG. 4A, another embodiment 400 for a contact lens storage case is illustrated. This may be one of two storage units needed as shown by the "R" designation 415, or alternatively, the same design could be made to fit left and right contact lenses. The figure (FIG. 4A) also includes novel thumb latches 411, 421 also having two compartments directly on top of one another in the same footprint. The two compartments initially comprise first and second base portions 420, 430, respectfully.

Figure 4B:
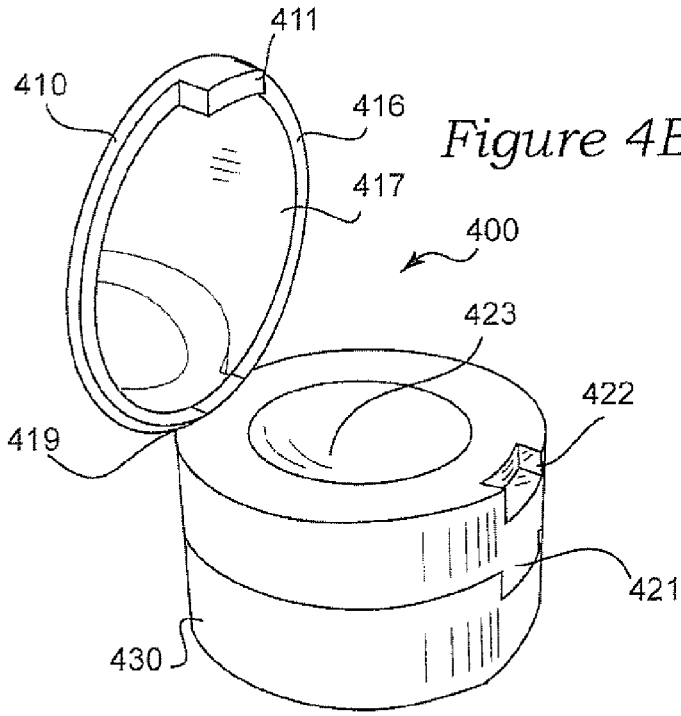
FIG. 4B is a perspective view of the embodiment having a mirror compartment deployed.
Figure 5:
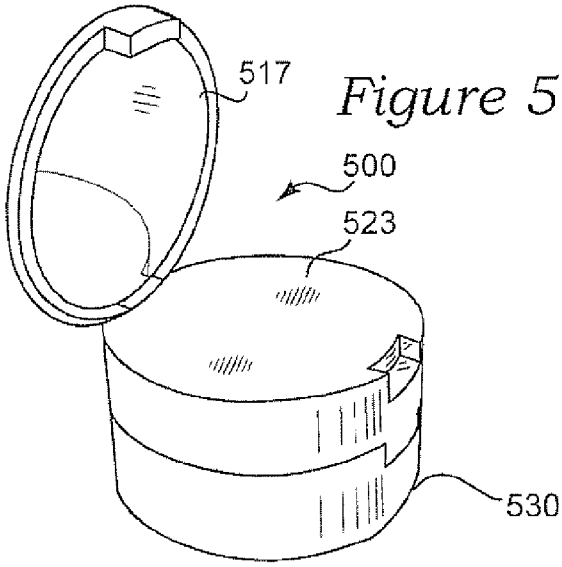
FIG. 5 illustrates an alternative embodiment where a first bowl reservoir of the FIGS. 4A-4C embodiment is substituted with a flat surface.

Referring, to FIG. 4B the first and second base portions 420, 430 each comprise a bowl-shaped reservoir 423, 433 for storing contact lenses. Cap 410 is provided to secure the upper compartment and is hingedly connected to the first base portion 420 via hinge 419. Hinge 419 comprises bendable and pliable plastic integral to the cap 410 and first base portion 420. A mirror compartment is provided at an underside of the cap 420 and comprises a basin 416 for receiving a reflective surface 417 embedded thereto. The reflective surface faces the first bowl reservoir 423 in a closed position. Or alternatively, this could be a dry compartment that simply protects the reflective surface 517 (FIG. 5).

Importantly, cap 410 includes a latch 411 protruding therefrom. Carve-out 422 is complementary shaped to receive latch 411. In a preferred embodiment, carve-out 422 is shaped like a truncated pie wedge cut at a perpendicular plane. Alternatively, this shape 422 may be characterized as a frustum of a pie-wedge. The invention 400 further comprises a similarly shaped second latch 421 directly underneath the first carve-out 422. As stated, in an alternative embodiment 500, first compartment is a dry compartment having a flat surface 523 opposing a mirror 517 and the second compartment is provided to receive one contact, as shown in FIG. 5. In this embodiment 500, a contact lens user would have two units 200 to store a complete set of two contacts. Further to this embodiment, base portion 530 comprises a reservoir to house a contact lens.

Figure 4C:
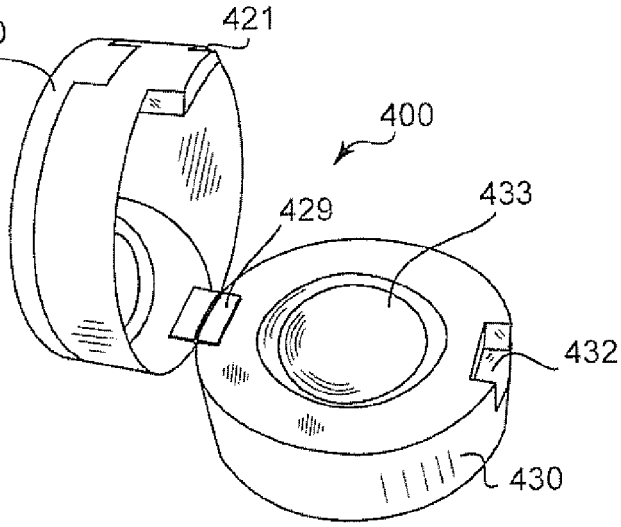
FIG. 4C is still another perspective view of a contact compartment also illustrating a thumb latch of the invention.

Now turning to FIG. 4C, a second contact compartment is shown, directly beneath the first compartment and in the same footprint. The second compartment comprises a second hinge 429 and a second base portion 430 having a second reservoir 433 for storing a second contact. Here also is shown a thumb latch 421 feature not existing in other designs. As stated, the first contact could be stowed in the mirror compartment, or in a different, identical design 500 separate for left and right contact lenses.

Figure 6:
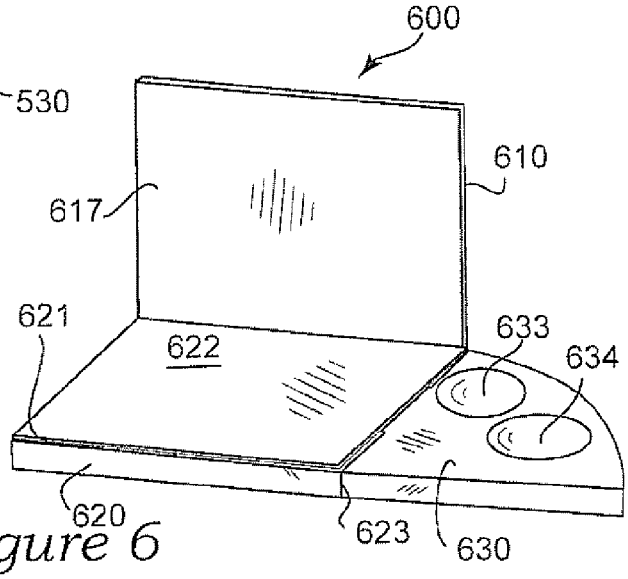
FIG. 6 illustrates another embodiment showing a business card case incorporated to a contact lens case.

FIG. 6 illustrates another embodiment 600 showing a business card case 620 incorporated to a contact lens case 630. The card case 620 is hollow to receive the contact lens case 630 hingedly about edge 623. Contact lens case has two reservoirs 633, 634 incorporated thereto. The card case 620 also has a basin 621 to receive business cards 622. A cover 610 is provided having a reflective surface 617 at an underside thereof.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Contact Lens Case as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A case for storing contact lenses comprising:

a first circular base portion having a hollow interior for storing contact lenses;

a first threaded cap having threads to engage complementary threads of the first circular base portion; and a first hinged cap hingedly connected to the first threaded cap, wherein the first circular base portion further comprises two identical bowl shaped reservoirs separated by a partitioning wall, the partitioning wall fixed to the first circular base portion, the partitioning wall having an S shaped partition, the S shaped partition forming a compact structure with respect to the first circular base portion, the two reservoirs further configured to store a contact lens a second circular base portion having a hollow interior for storing contact lenses, wherein each of the first and second circular base portions comprise two reservoirs for storing a total of four contact lenses;

a plurality of indentations evenly spaced around the first threaded cap to aid grasping thereof by a user;

a groove at an underside of the first circular base portion, the groove configured to receive an edge of a spare contact lens package, wherein the groove is circumferential with respect to the first circular base portion; and a dome-shaped cavity formed partially by said groove for receiving the spare contact lens package.

2. The case for storing contact lenses of claim 1, wherein the first hinged cap comprises a reflective surface at an underside thereof.

3. The case for storing contact lenses of claim 1, further comprising:

a first hinge comprised of pliable material to connect the first hinged cap to the first threaded cap; and a first thumb latch to assist in opening the first hinged cap, wherein the first hinge and the first thumb latch are offset at an angle with respect to a vertical axis, the vertical axis representing a twelve o'clock position with respect to first hinged cap.

4. The case for storing contact lenses of claim 1, further comprising:

a second threaded cap having threads to engage complementary threads of the second circular base portion; and a second hinged cap hingedly connected to the second threaded cap, wherein the second hinged cap comprises a reflective surface at an underside thereof.

5. A case for storing contact lenses comprising:

a first circular base portion having a hollow interior for storing contact lenses;

a first threaded cap having threads to engage complementary threads of the first circular base portion;

a groove at an underside of the first circular base portion, the groove configured to receive an edge of a spare contact lens package, wherein the groove is circumferential with respect to the first circular base portion; and a circular dome-shaped cavity formed partially by said groove for receiving the spare contact lens package, wherein the first circular base further comprises two reservoirs separated by an S shaped partitioning wall, the two reservoirs together forming a yin yang shape.

6. The case for storing contact lenses of claim 5, further comprising a plurality of indentations evenly spaced around the first threaded cap to aid grasping thereof by a user.

7. The case for storing contact lenses of claim 5, further comprising a first hinged cap hingedly connected to the first threaded cap, wherein the first hinged cap comprises a reflective surface at an underside thereof.

8. The case for storing contact lenses of claim 7, further comprising:

a first hinge comprised of pliable material to connect the first hinged cap to the first threaded cap; and a first thumb latch to assist in opening the first hinged cap, wherein the first hinge and the first thumb latch are offset at an angle with respect to a vertical axis, the vertical axis representing a twelve o'clock position with respect to first hinged cap.

9. The case for storing contact lenses of claim 7, further comprising:

a second circular base portion having a hollow interior for storing contact lenses;

a second threaded cap having threads to engage complementary threads of the second circular base portion; and a second hinged cap hingedly connected to the second threaded cap, wherein the second hinged cap comprises a reflective surface at an underside thereof, and wherein each of the first and second base portions comprise two reservoir for storing a total of four contact lenses.

10. A case for storing contact lenses comprising:

a first circular base portion having a first hinged cap, the first circular base portion further having a hollow interior for storing one or more contact lenses, the first hinged cap having a first hinge associated therewith;

a second circular base portion having a hollow interior for storing one or more contact lenses; and a first thumb latch to assist in opening the first hinged cap, wherein the first hinge and the first thumb latch are offset at an angle with respect to a vertical axis, the vertical axis representing a twelve o'clock position with respect to first hinged cap, wherein each of the first and second circular base portions comprise two reservoirs for storing a total of four contact lenses, and further wherein the first and second circular base portions are configured horizontally with respect to each other.

11. The case for storing contact lenses of claim 10, wherein the first circular base portion further comprises two identical bowl shaped reservoirs separated by a partitioning wall, the partitioning wall fixed to the first circular base portion, the partitioning wall further having an S shaped partition, the S shaped partition forming a compact structure with respect to the first circular base portion.

* * * * *